US007367820B2

(12) United States Patent
Kikuchi

(10) Patent No.: US 7,367,820 B2
(45) Date of Patent: May 6, 2008

(54) CONNECTOR WITH GROUND CONNECTION IMPROVED IN PROTECTION AGAINST A NOISE TROUBLE

(75) Inventor: Masayuki Kikuchi, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 11/635,710

(22) Filed: Dec. 7, 2006

(65) Prior Publication Data

US 2007/0128897 A1 Jun. 7, 2007

(30) Foreign Application Priority Data

Dec. 7, 2005 (JP) ..... 2005-353855

(51) Int. Cl.
*H01R 4/66* (2006.01)

(52) U.S. Cl. ..... 439/108

(58) Field of Classification Search ..... 439/607–610, 439/579, 497, 484, 108
See application file for complete search history.

(56) References Cited

U.S. PATENT DOCUMENTS 6,338,652 B1 * 1/2002 Ko ..... 439/579
6,454,606 B2 9/2002 Igarashi
6,705,893 B1 * 3/2004 Ko ..... 439/607
6,830,478 B1 12/2004 Ko
2004/0127098 A1 7/2004 Kuo et al.

FOREIGN PATENT DOCUMENTS

JP 2001-307822 11/2001

OTHER PUBLICATIONS

Extended European Search Report (dated Feb. 27, 2007).

* cited by examiner

*Primary Examiner*—Edwin A. Leon
(74) *Attorney, Agent, or Firm*—Collard & Roe, P.C.

(57) ABSTRACT

In a connector including a first contact having a terminal portion to be connected to a center conductor of a cable, a second contact is held together with the first contact by a housing. The second contact has a grounding terminal portion. A ground bar clamps the cable and is connected to an outer conductor of the cable. A shell is coupled to the housing. The ground bar has a contact connecting terminal to be connected to the grounding terminal portion of the second contact. The shell at least covers the terminal portion of the first contact, the grounding terminal portion of the second contact, and the ground bar. At least one of the ground bar and the shell has a shell connecting terminal to be connected to a shell of a mating connector.

6 Claims, 8 Drawing Sheets

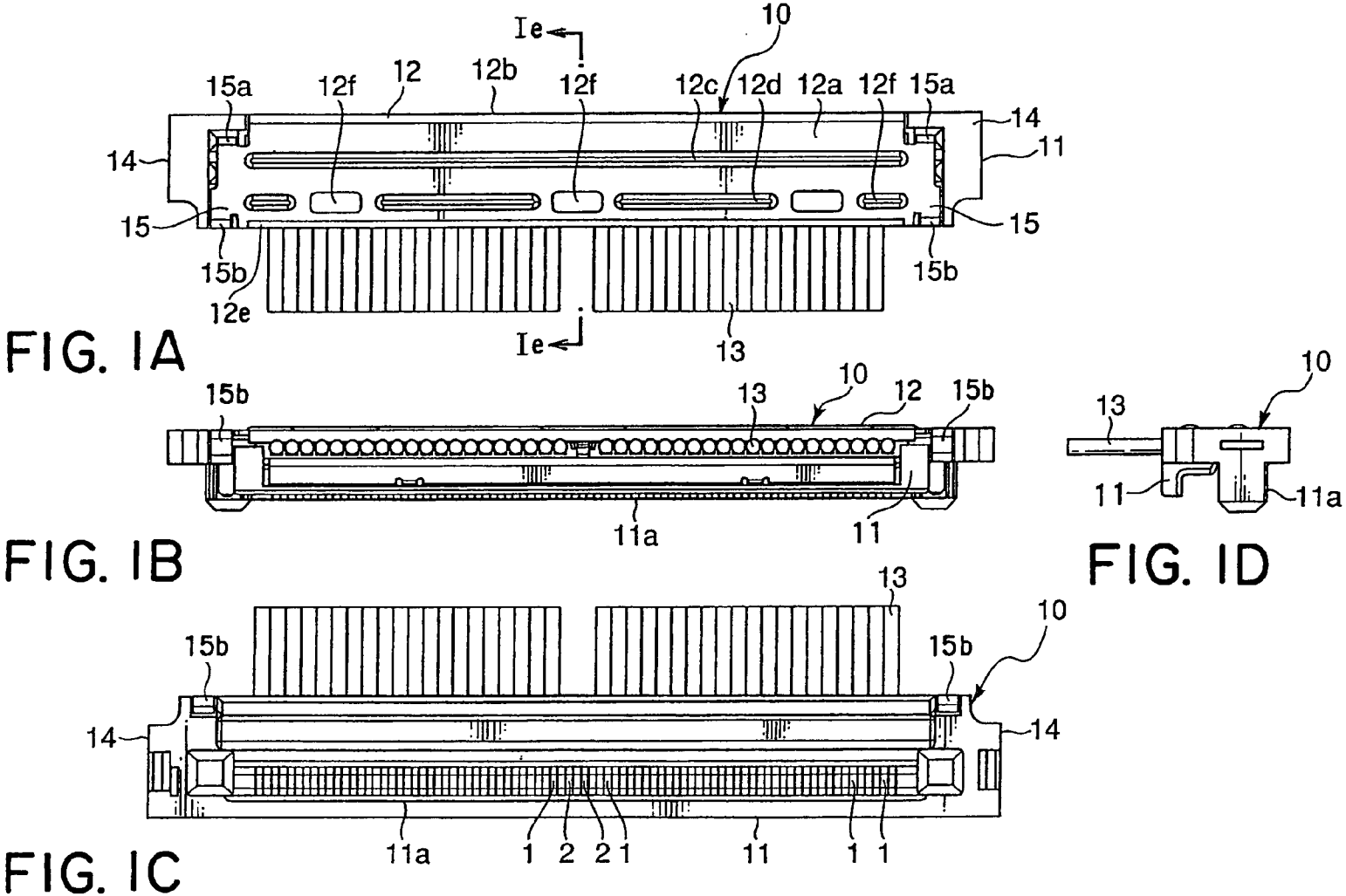
FIG. IA
FIG. IB
FIG. IC
FIG. ID

CONNECTOR WITH GROUND CONNECTION IMPROVED IN PROTECTION AGAINST A NOISE TROUBLE

This application claims priority to prior Japanese patent application JP 2005-353855, the disclosure of which is incorporated herein by reference.

BACKGROUND OF THE INVENTION

This invention relates to a connector adapted to be used in high-speed transmission and, in particular, to a connector suitable for a small-sized electronic apparatus such as a PDA (Portable Digital Assistant) and a mobile telephone.

For high-speed transmission, a coaxial cable is generally used widely. The coaxial cable comprises a center conductor and an outer conductor surrounding the center conductor via an insulating member. Therefore, a connector to be connected to the coaxial cable comprises a contact to be connected to the center conductor and a ground connection structure to be connected to the outer conductor.

Japanese Unexamined Patent Application Publication (JP-A) No. 2001-307822 discloses a connector including such ground connection structure. The connector comprises a shell covering an insulator holding a contact to be connected to a coaxial cable. The shell comprises a first shell member arranged at a position corresponding to a contacting portion of the contact and fixedly held by the insulator and a second shell member removably held by the insulator. The second shell member has a holding portion clamping and holding the coaxial cable in cooperation with the insulator.

The above-mentioned ground connector structure is connected to a mating connector via the shell. In addition, the number of points of ground connection is small. Therefore, an electric resistance is increased. As a result, a ground condition is insufficient so that a noise generated from a signal line is not sufficiently shielded to often cause a noise trouble.

SUMMARY OF THE INVENTION

It is therefore an object of this invention to provide a connector which can be considerably reduced in electric resistance in ground connection and is therefore improved in protection against a noise trouble.

It is another object of this invention to provide a connector capable of efficiently achieving ground connection of a ground line of a shielding wire of a thin coaxial cable used in a small-sized electronic apparatus such as a mobile telephone and a PDA.

Other objects of the present invention will become clear as the description proceeds.

According to an aspect of the present invention, there is provided a connector to be connected to a cable. The connector comprises a first contact having a terminal portion to be connected to a center conductor of the cable, a second contact having a grounding terminal portion, a housing holding the first and the second contacts, a ground bar clamping the cable and connected to an outer conductor of the cable, and a shell coupled to the housing. The ground bar has a contact connecting terminal to be connected to the grounding terminal portion of the second contact. The shell at least covers the terminal portion of the first contact, the grounding terminal portion of the second contact, and the ground bar. At least one of the ground bar and the shell has a shell connecting terminal to be connected to a shell of a mating connector.

BRIEF DESCRIPTION OF THE DRAWING

FIGS. 1A to 1D are a plan view, a rear view, a bottom view, and a side view showing a plug connector as a connector according to one embodiment of this invention;

DESCRIPTION OF THE PREFERRED EMBODIMENTS

Figure 1E:
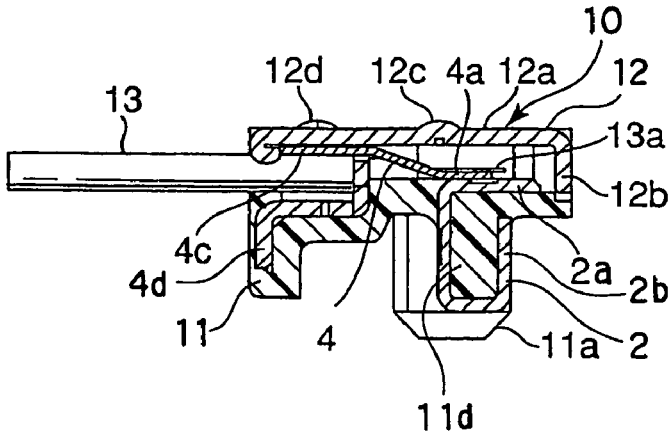
FIG. 1E is a sectional view taken along a line le-le in FIG. 1A.

Referring to FIGS. 1A to 6, description will be made of a structure of a connector according to one embodiment of this invention.

At first referring to FIGS. 1A to 1F, a plug connector 10 for high-speed transmission comprises a plurality of signal contacts as first contacts 1 and a pair of ground contacts 2 as second contacts each of which is made of a thin, long conductive material, an insulating housing 11 holding the signal contacts 1 and the ground contacts 2, a conductive ground bar 4 holding a plurality of cables 13 comprising coaxial cables and coupled to the housing 11, and a plug shell 12 made of a metal plate and covering the housing 11 and the ground bar 4 from the above. On opposite sides of the plug shell 12, a pair of plug shell holding portions 15 are formed. The plug shell holding portions 15 are held by a pair of fixing portions 14 formed on left and right sides of the housing 11, respectively.

The housing 11 is provided with a fitting portion 11*a* formed on its front side to be fitted to a mating connector. From a rear side of the housing 11, the cables 13 connected to the contacts 1 and 2 are extracted. The plug connector 10 illustrated in the figures has a small size, for example, with a length of 16.5 mm, a height of 1.4 mm, and a width of 2.3 mm.

Figure 2A:
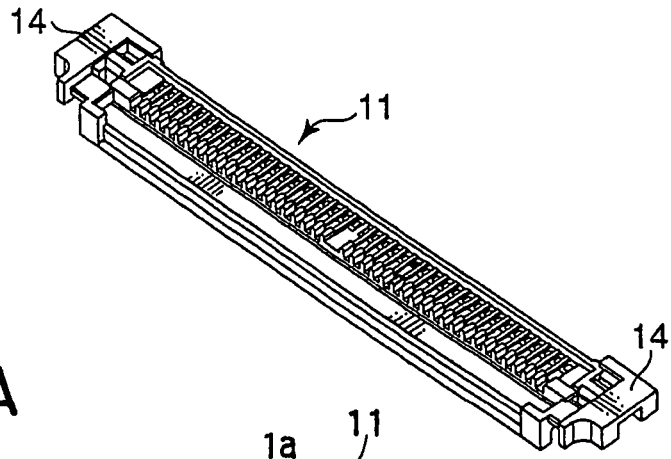
FIG. 2A is a perspective view of a housing of the plug connector illustrated in FIGS. 1A to 1D.
Figure 2B:
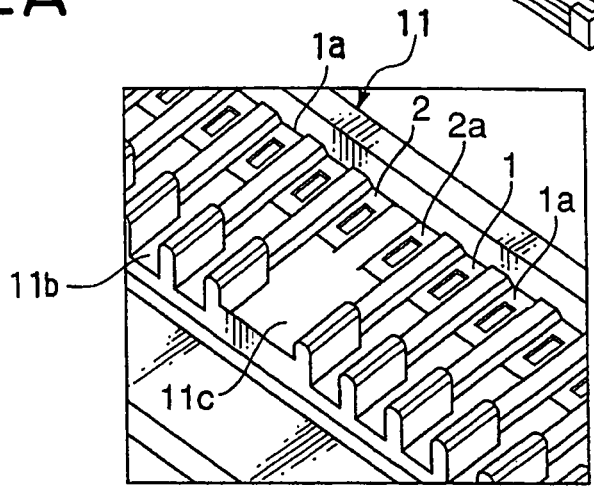
FIG. 2B is an enlarged view of a part of FIG. 2A.
Figure 2C:
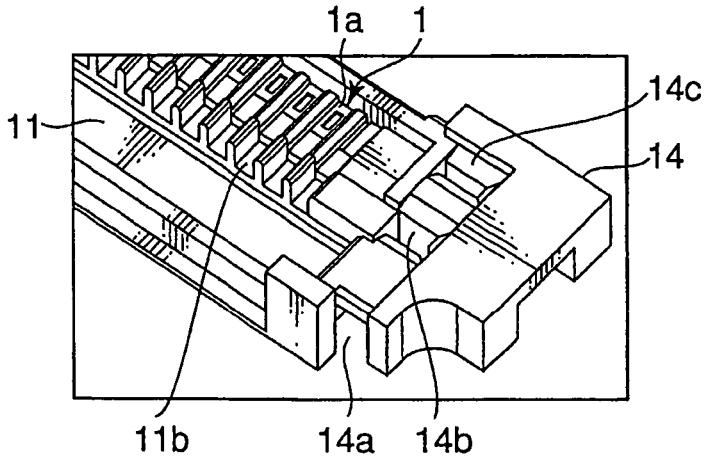
FIG. 2C is an enlarged view of another part of FIG. 2A.

As illustrated in FIGS. 2A to 2C, the housing 11 of the plug connector 10 has an upper surface provided with receiving grooves 11*b* assigned to the signal contacts 1 and with another receiving groove 11*c* which is formed at a center of the housing 11 and assigned to the ground contacts 2. Each of the signal contacts 1 has a terminal portion 1*a* which is placed in each receiving groove 11*b* and serves as a connecting portion to be connected to a center conductor 13*a* of each cable 13. The ground contacts 2 include, as a grounding terminal portion, terminal portions 2*a*, respectively, which are placed in the receiving groove 11*c* that is positioned at the middle portion of the housing 11. Each of the ground contacts 2 further includes another terminal portion 2*b* extending along a projecting wall 11*d* of the housing 11 and serving as a shell connecting terminal connected to a shell of a mating connector which will later be described with reference to FIGS. 8A-9C.

In the housing 11, the fixing portions 14 are formed on the opposite sides thereof to receive the plug shell 12. Each of the fixing portions 14 is provided with a ground bar fitting hole 14*b* and a ground bar fitting groove 14*c*.

Figure 3:
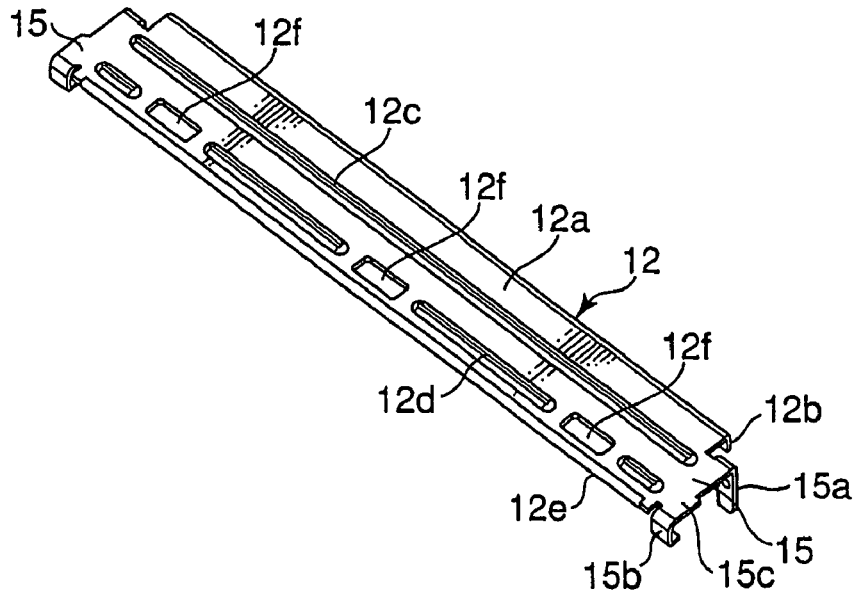
FIG. 3 is a perspective view of a plug shell of the plug connector illustrated in FIGS. 1A to 1D.

As shown in FIG. 3, the plug shell 12 is provided with the plug shell holding portions 15 formed on its opposite sides. Each of the plug shell holding portions 15 has a plug shell connecting member 15*a* formed on its front side and extending downward and a C-shaped plug shell connecting member 15*b* formed on its rear side. The plug shell connecting members 15*a* and 15*b* cooperate with each other to fix the plug shell 12 to the fixing portions 14 of the housing 11. The plug shell 12 has a front end portion 12*b* bent in a generally vertical direction and a rear end portion 12*e* bent upward in a rounded shape. The plug shell 12 has an opening portion 12*f* formed on its rear side to serve as a soldering hole as will later be described.

Figure 4:
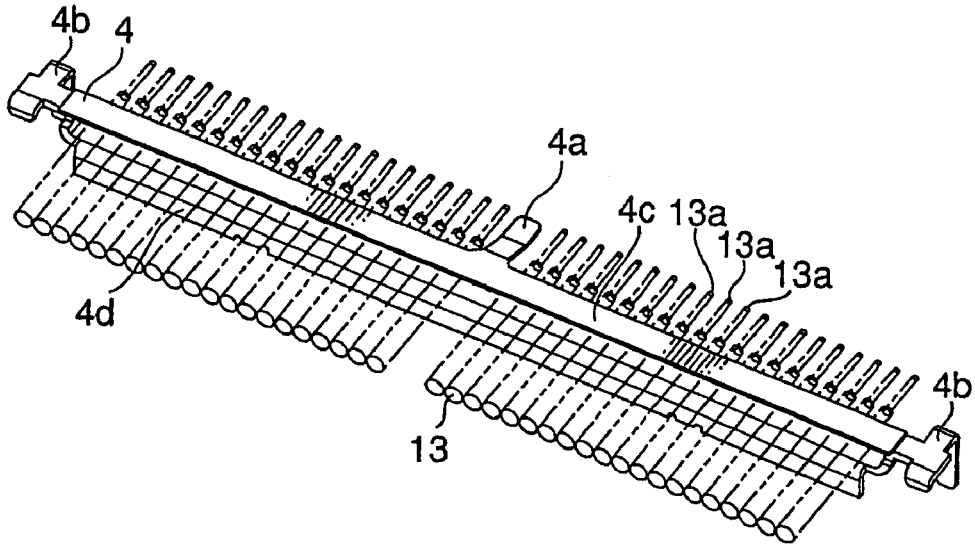
FIG. 4 is a perspective view of a cable assembly including a cable held by a ground bar.

Referring to FIG. 4, the ground bar 4 includes a ground bar body 4*c*, a cable holding member 4*d* having a generally S-shaped section, and a pair of ground bar connecting members 4*b* having a generally U shape and formed on left and right sides of the ground bar body 4*c*. The ground bar body 4*c* includes a contact connecting terminal (contact connecting member) 4*a* formed at its center and extending frontward. The contact connecting terminal 4*a* includes an inclined part extending from the ground bar body 4*c* and a horizontal part extending from the inclined part. The horizontal part of the contact connecting member 4*a* is soldered and connected to the connecting portions 2*a* of the ground contacts 2 illustrated in FIG. 1E.

The ground bar 4 preliminarily holds the cables 13. Specifically, each of the cables 13 has the center conductor 13*a*, an outer conductor (not shown) surrounding the center conductor 13*a* via an insulating member, and an outer sheath (not shown) covering the outer conductor. The cables 13 are arranged at a predetermined pitch in a transversal direction. The outer conductor has an exposed part clamped between the ground bar body 4*c* and the cable holding member 4*d* and fixed by soldering. At one end of each cable 13, the center conductor 13*a* is exposed. At a part spaced from the one end, the outer conductor is exposed.

Figure 5:
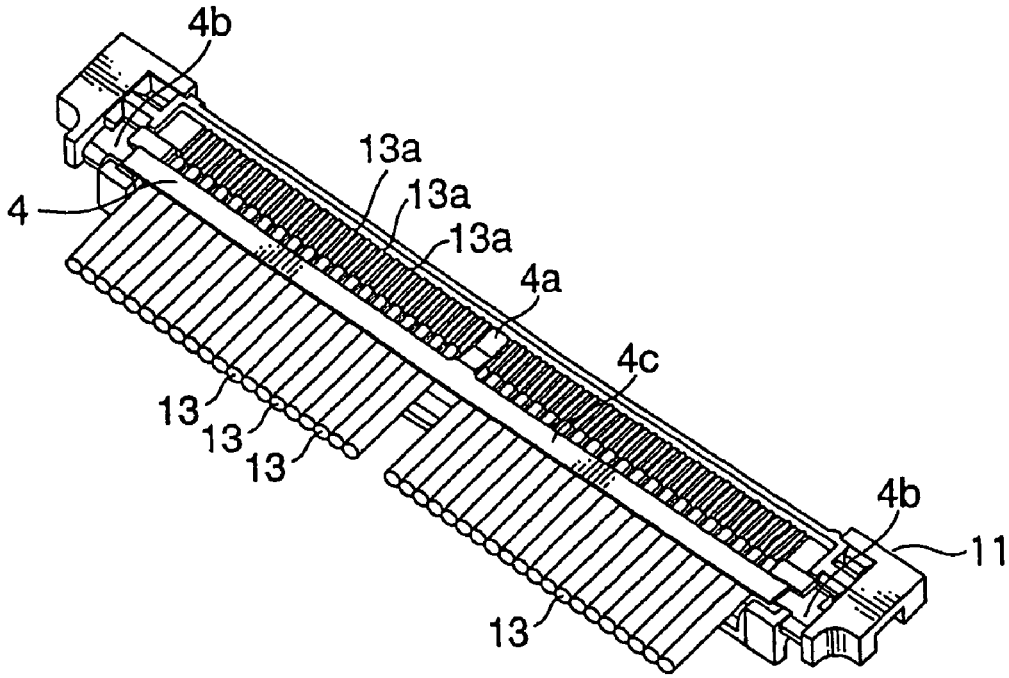
FIG. 5 is a perspective view of the cable assembly in FIG. 4 when it is fixed to the housing illustrated in FIG. 2A.

Each of the ground bar connecting members 4*b* is inserted into the ground bar fitting hole 14*b* and the ground bar fitting groove 14*c* of the fixing portion 14 as clearly shown in FIG. 2C. Thus, the ground bar 4 is held by the housing 11 as illustrated in FIG. 5. After the ground bar 4 is held by the housing 11, the center conductors 13*a* of the cables 13 held by the ground bar 4 are soldered and fixed to the connecting portions (terminal portions) 1*a* of the signal contacts 1 located in the receiving grooves 11*b* of the housing 11, respectively.

Figure 6:
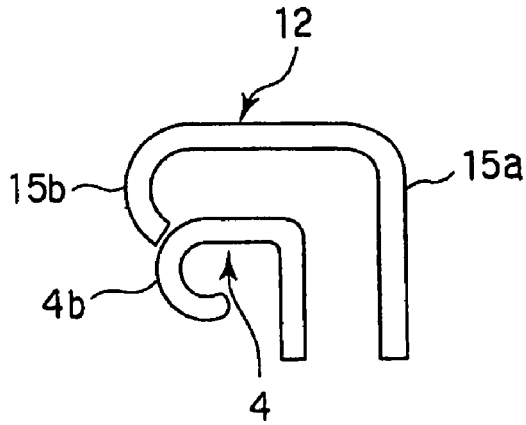
FIG. 6 is a view for describing the positional relationship between the ground bar and the plug shell.

As clearly shown in FIG. 1E, the ground bar 4 is covered with the plug shell 12. At this time, as illustrated in FIG. 6, the positional relationship between the ground bar 4 and the plug shell 12 is fixed in the state where the plug shell holding portions 15*b* are located above the ground bar connecting members 4*b*.

Figure 7A:
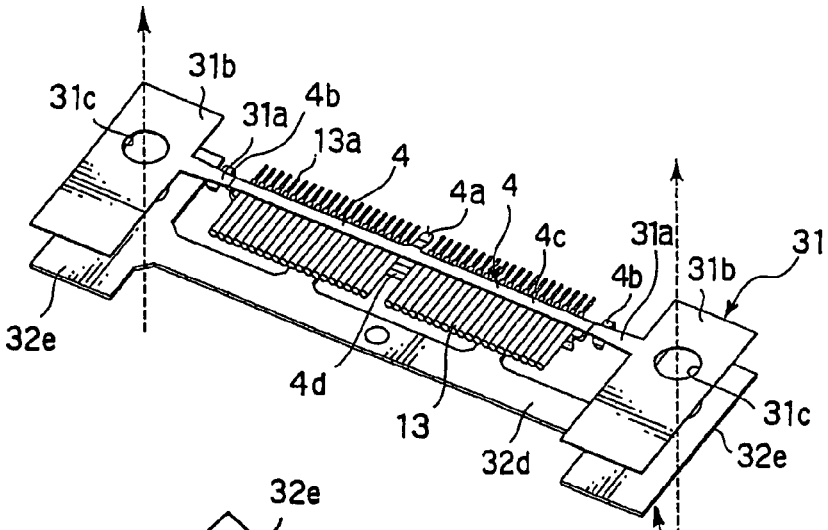
FIG. 7A is a perspective view of the cable assembly in FIG. 4 during a production process as seen from one side.
Figure 7B:
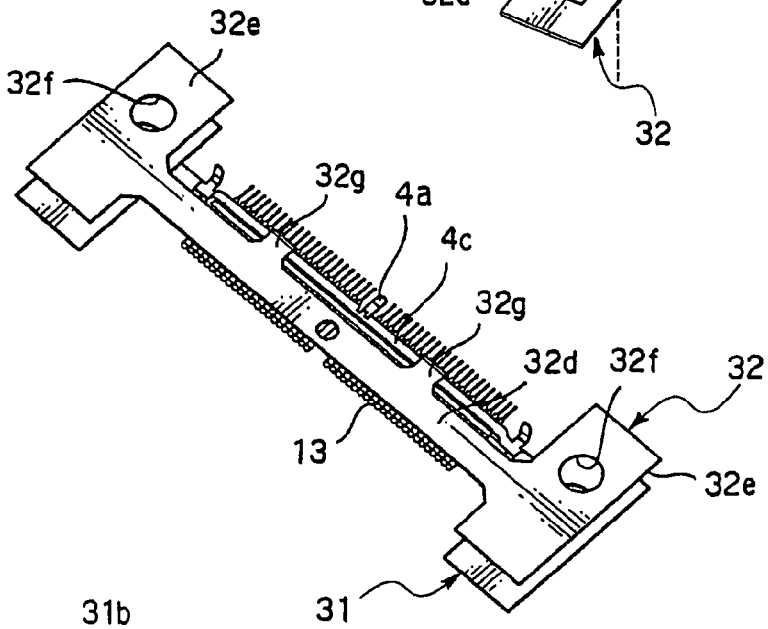
FIG. 7B is a perspective view similar to FIG. 7A as seen from the opposite side.
Figure 7C:
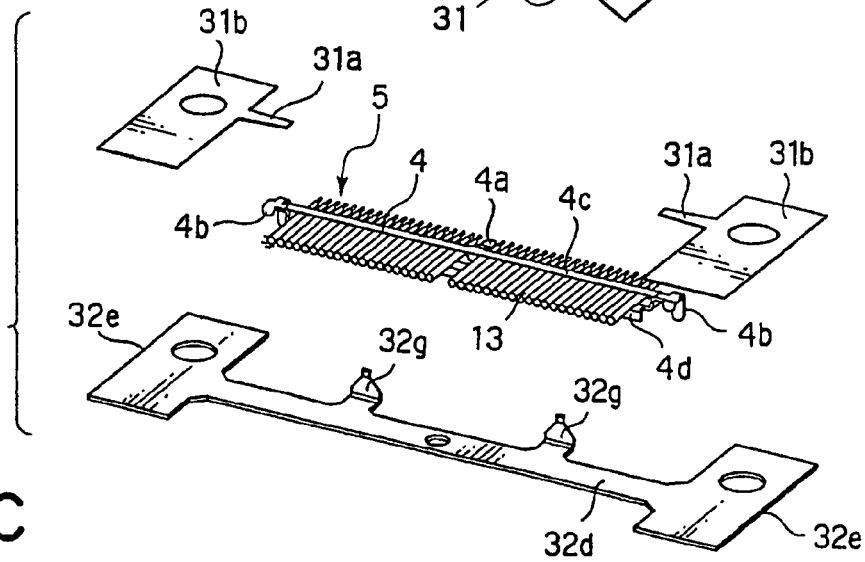
FIG. 7C is a perspective view of the cable assembly in FIG. 4 after completion of the production process as seen from the one side.
Figure 8A:
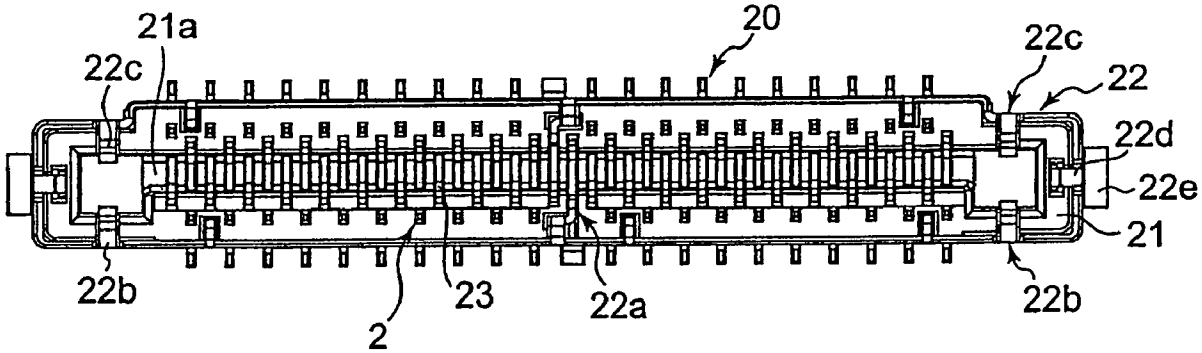
FIGS. 8A to 8D are a plan view, a front view, a bottom view, and a side view showing, as a connector according to another embodiment of this invention, a receptacle connector to be connected to the plug connector in FIGS. 1A to 1D.
Figure 8B:
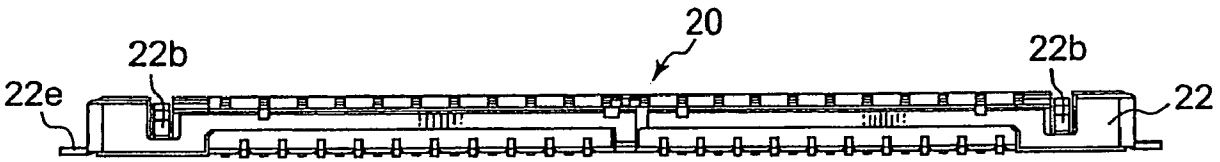
Figure 8C:
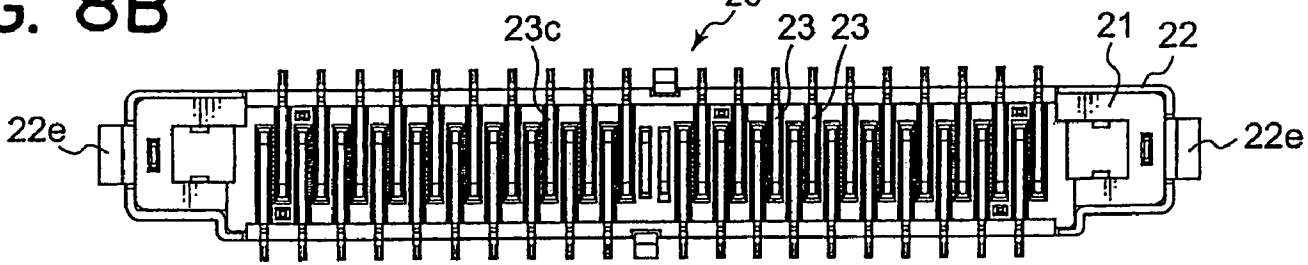
Figure 8D:
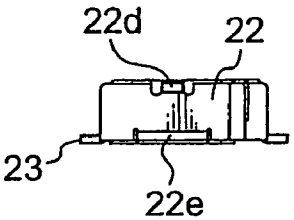

Referring to FIGS. 7A to 7C, description will be made of a method of producing a structure including the cables 13 held by the ground bar 4, i.e., a cable assembly 5. A part to finally become the ground bar 4 is designated by same reference numerals as those in FIG. 4.

As illustrated in FIGS. 7A and 7B, a member for forming the ground bar 4 includes first and second plate members 31 and 32 extending in a widthwise direction. The first and the second plate members 31 and 32 are formed integral to each other by press-punching and bending a single metal plate. In the state illustrated in FIGS. 7A and 7B, transportation and handling are carried out.

The ground bar 4 is formed by a part of the first plate member 31. The first plate member 31 includes a pair of first straight portions 31 b formed on outer sides of the ground bar 4 via a pair of connecting portions 31*a*, respectively. Each of the straight portions 31*b* has a circular hole 31*c* for positioning.

On the other hand, the second plate member 32 has a long supporting portion 32*d* extending in a longitudinal direction and a pair of straight portions 32*e* formed on longitudinal opposite ends of the supporting portion 32*d* and extending in a direction perpendicular to the longitudinal direction. Each of the straight portions 32*e* has a positioning hole 32*f* formed at its center. The supporting portion 32*d* of the second plate member 32 is connected to the cable holding member 4*d* of the ground bar 4 via two connecting portions 32*g*.

As illustrated in FIG. 7C, the connecting portions 31*a* and 32*g* are cut off to separate the cable assembly 5 from the other part. Thus, the cable assembly 5 including the cables 13 held by the ground bar 4 is obtained.

Turning back to FIGS. 1E and 1F , description will be made of assembling of the plug connector 10.

Figure 1F:
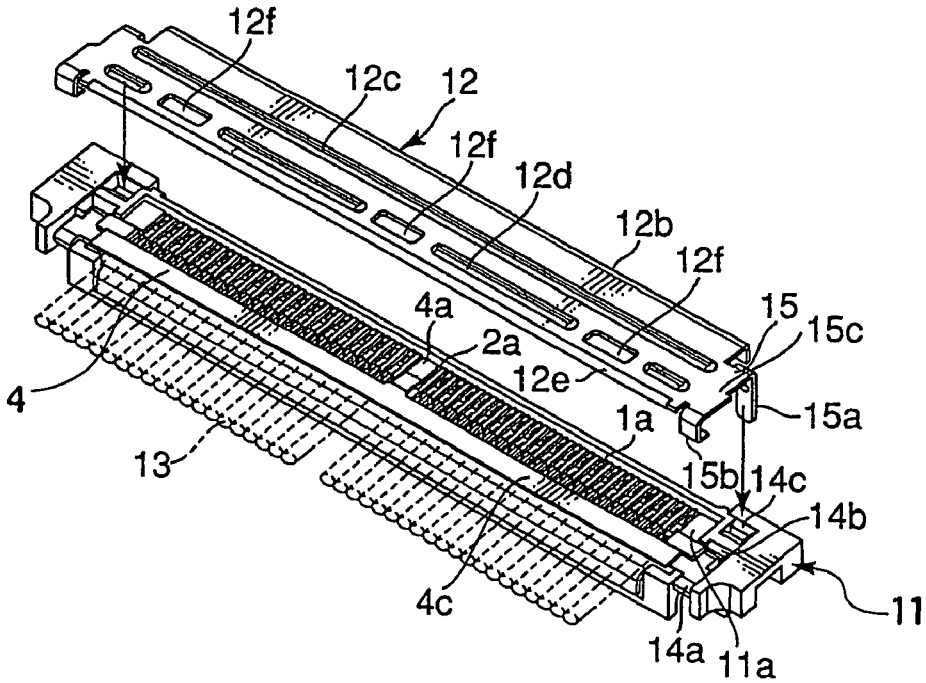
FIG. 1F is an exploded perspective view of the plug connector illustrated in FIGS. 1A to 1D.

As illustrated in FIG. 1F, the cable assembly 5 is fixed to the housing 11 and the center conductors 13*a* at one ends of the cables 13 are fixed by soldering to the terminal portions 1*a* of the contacts 1. The plug shell connecting members 15*a* and 15*b* are fitted to the shell fitting holes 14*c* and the shell fitting grooves 14*a* formed on the fixing portions 14 at the opposite sides of the housing 11, respectively. Thus, the plug shell 12 is fixed and covers the ground bar connecting members 4*b* at the opposite sides of the ground bar body 4*c*.

In the above-mentioned manner, the plug shell 12 and the ground bar 4 are securely connected as illustrated in FIG. 1E. The contact connecting terminal (connecting member) 4*a* of the ground bar 4 is soldered and fixed to the terminal portions 2*a* of the ground contacts 2 at the center.

As illustrated in FIG. 1F, the plug shell connecting members 15*a* and 15*b* on the opposite sides of the plug shell 12 are fitted to the fixing portions 14. At this time, the ground bar body 4*c* and the shell 12 are electrically connected and fixed to each other with a solder fillet standing around the opening portion 12*f*.

With the above-mentioned plug connector 10, it is possible to achieve direct ground connection from the ground bar. Because the number of connection points is large, it is possible to considerably lower an electric resistance. Therefore, it is possible to provide ground connection improved in protection against a noise trouble. Further, it is possible to efficiently achieve ground connection of a shield wire of a thin coaxial cable used in a small-sized electronic apparatus such as a portable telephone and a PDA.

Next referring to FIGS. 8A to 9C, description will be made of a receptacle connector as the mating connector.

FIGS. 8A to 8D show the receptacle connector 20 that is for high-speed transmission. The receptacle connector 20 is adapted to be connected to the plug connector 10 illustrated in FIGS. 1A to 1F. The receptacle connector 20 has a small size, for example, with a width of 17.3 mm, a height of 0.95 mm, and a length of 2.4 mm. The receptacle connector 20 is mounted to a substrate and fitted to the plug connector 10 illustrated in FIG. 1A to achieve connection of the coaxial cables. The receptacle connector 20 comprises a housing 21, a shell 22 covering a side surface of the housing 21, and a plurality of signal contacts 23 held by the housing 21. Each of the signal contacts 23 has an L shape. The signal contacts 23 have one ends extending to outsides of opposite wall portions of the housing 21 to form soldering portions.

Figure 9C:
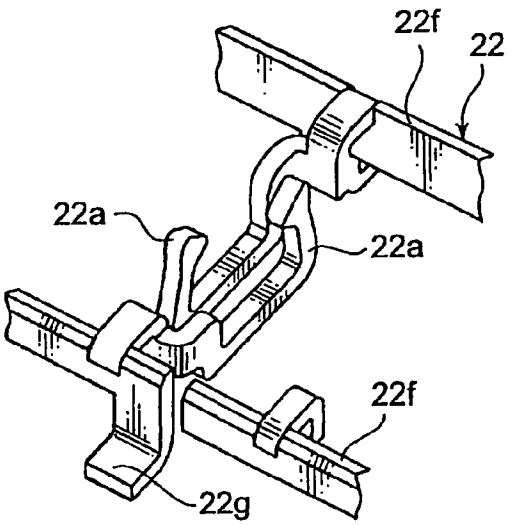
FIG. 9C is an enlarged view of a part of FIG. 9B.
Figure 9A:
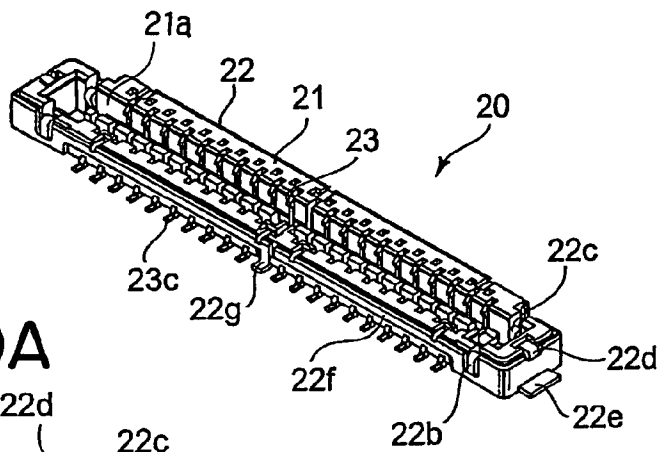
FIG. 9A is a perspective view of the receptacle connector illustrated in FIGS. 8A to 8D.
Figure 9B:
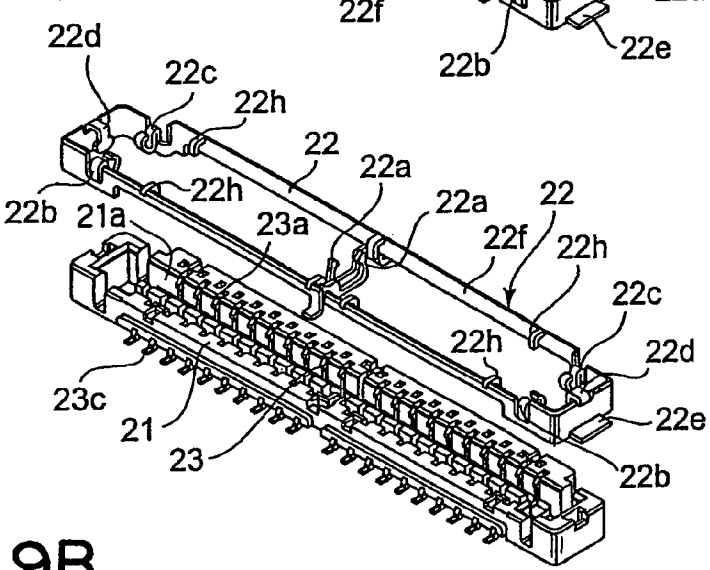
FIG. 9B is an exploded perspective view of the receptacle connector illustrated in FIGS. 8A to 8D.

As shown in FIGS. 9A to 9C, the housing 21 is provided with a long groove 21*a* formed at its center, extending along a longitudinal direction thereof, and opened upward. Along a wall portion of the groove 21*a*, the contacts 23 are arranged on a plane perpendicular to a longitudinal direction of the groove 21*a*. The contacts 23 are held by the housing 21 and the receptacle shell 22 are fitted to cover an outer periphery of the housing 21 and the contacts 23. The receptacle shell 22 has a pair of first shell contacts 22*a* formed at its center, a pair of second shell contacts 22*b*, and a pair of third shell contacts 22*c*. The first shell contacts 22*a* have a generally U shape and have end portions exposed outward from opposite frame sides 22*f* of the receptacle shell 22. The second shell contacts 22*b* and the third shell contacts 22*c* are formed on opposite sides to face each other. The receptacle shell 22 has a pair of soldering terminal portions 22*g* formed outside to be soldered to the substrate and a pair of soldering terminal portions 22*e* formed on opposite sides thereof. When the plug connector 10 is fitted to the receptacle connector 22, the other terminal portion 2*b* of each ground contact 2 of the plug connector 10 becomes in contact with each shell contact 22*a* of the receptacle connector 20 so that ground connection is established.

While the present invention has thus far been described in connection with a few preferred embodiments thereof, it will readily be possible for those skilled in the art to put this invention into practice in various other manners. Although the description is made about the connector including a plurality of signal contacts and a pair of ground contact, the present invention is applicable also to a connector including a single signal contact and a single ground contact.

What is claimed is:

1. A connector to be connected to a cable, the connector comprising:

a first contact having a terminal portion to be connected to a center conductor of the cable;

a second contact having a grounding terminal portion;

a housing holding the first and the second contacts;

a ground bar coupled to the housing; and a shell coupled to the housing;

the shell at least covering the terminal portion of the first contact, the grounding terminal portion of the second contact, and the ground bar; and the shell having a shell connecting member to be connected to a shell of a mating connector, wherein the ground bar comprises:

a ground bar body extending along the housing and cooperated with the housing for clamping the cable;

a cable holding member extending from the ground bar body for contacting an outer conductor of the cable;

a contact connecting terminal extending from the ground bar body and being in contact with the grounding terminal portion of the second contact; and a ground bar connecting member connected to an extended end of the ground bar body and held by the housing, the ground bar connecting member being connected to the shell connecting member.

2. The connector according to claim 1, wherein the contact connecting terminal is connected to the ground bar body.

3. The connector according to claim 1, wherein the housing has a fitting hole and a fitting groove, the ground bar connecting member being fitted to the fitting hole and the fitting groove.

4. The connector according to claim 1, wherein the ground bar is coupled to the housing to make a cable assembly holding the cable.

5. The connector according to claim 1, wherein the shell has a shell holding portion, the shell holding portion having a pair of shell connecting members cooperating with each other to be fixed to the housing.

6. A mating connector to be connected to the connector according to claim 1, the mating connector comprising:

a mating signal contact;

a mating housing holding the mating signal contact; and a mating shell covering an outer periphery of at least a part of the mating housing;

the mating shell comprising:

a first shell contact to be connected to the second contact; and a second shell contact to be connected to the shell connecting terminal.

* * * * *